US007718050B2

(12) United States Patent
Gueret et al.

(10) Patent No.: US 7,718,050 B2
(45) Date of Patent: May 18, 2010

(54) PROCESS OF MILD HYDROCRACKING INCLUDING A DILUTION OF THE FEEDSTOCK

(75) Inventors: Christophe Gueret, St Romain en Gal (FR); Thierry Chapus, Lyons (FR); Damien Hudebine, Lyons (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 88 days.

(21) Appl. No.: 11/449,867

(22) Filed: Jun. 9, 2006

(65) Prior Publication Data

US 2006/0289338 A1 Dec. 28, 2006

(30) Foreign Application Priority Data

Jun. 9, 2005 (FR) ..... 05 05865

(51) Int. Cl.
*C10G 57/00* (2006.01)
*B01J 8/18* (2006.01)

(52) U.S. Cl. ..... 208/67; 208/58; 208/59; 208/89; 208/96; 208/111.3; 208/111.35; 208/254 H

(58) Field of Classification Search ..... 208/58, 208/59, 67, 89, 96, 111.3, 111.35, 254 H
See application file for complete search history.

(56) References Cited

U.S. PATENT DOCUMENTS 2,914,457 A 11/1959 Beavon
6,280,606 B1 * 8/2001 Morel et al. ..... 208/58
2003/0111385 A1 * 6/2003 Cash et al. ..... 208/58
2004/0050753 A1 * 3/2004 Marion et al. ..... 208/89

FOREIGN PATENT DOCUMENTS

FR 2864103 6/2005

* cited by examiner

*Primary Examiner*—In Suk Bullock
*Assistant Examiner*—Prem C. Singh
(74) *Attorney, Agent, or Firm*—Miller, White, Zelano, Branigan, P.C.

(57) ABSTRACT

The invention relates to a process for FCC pretreatment by mild hydrocracking of a hydrocarbon feedstock that comprises a vacuum distillate fraction or a deasphalted oil or else a mixture of these two fractions, said primary feedstock, to produce gas oil and an effluent having an initial boiling point of more than 320° C., said effluent (FCC feedstock) then being subjected to a catalytic cracking, process in which at least 85% by weight of said primary feedstock ends above 375° C. and at least 95% by weight of said primary feedstock ends below 650° C., whereby the mild hydrocracking is performed under an absolute pressure of 2 to 12 MPa and at a temperature of between 300 and 500° C., characterized in that the hydrocarbon feedstock also comprises a lighter hydrocarbon fraction, a so-called secondary feedstock, of which at least 50% by weight ends below 375° C. and at least 80% ends above 200° C.

13 Claims, 4 Drawing Sheets

PROCESS OF MILD HYDROCRACKING INCLUDING A DILUTION OF THE FEEDSTOCK

FIELD OF THE INVENTION

This invention lies in the technical field of the cracking of hydrocarbon feedstocks. More particularly, the invention relates to a process in which a vacuum distillate fraction or a deasphalted oil or else a mixture of these two fractions is diluted by a lighter fraction, for example of gas oil type, before its mild hydrocracking treatment, whereby this mild hydrocracking stage is prior to treatment by FCC.

PRIOR ART

The mild hydrocracking proves to be a particularly advantageous application for FCC pretreatment. It is actually well known that the sulfur content in the FCC gasolines as well as the $NO_x$ and $SO_x$ emissions are reduced in particular when a hydrotreatment process is used upstream from the FCC.

The reduction of the sulfur content of the FCC gasolines is essential since they constitute a large portion of the gasoline pool of a refinery. In addition, the tightening of the standards, already in force in 2005, relating to the quality of the fuels, makes it necessary to be oriented toward innovating diagrams making it possible, among other things, to reach sulfur contents of less than 10 ppm in the gasolines and in the gas oils (specifications for Europe). In addition to the sulfur content, it is also important to reduce the contents of nitrogen, aromatic compounds and polyaromatic compounds.

Various hydrodesulfurization processes are well known, and mild hydrocracking applies to the treatment of vacuum distillate-type feedstocks (DSV in abbreviated form) or VGO (corresponding to the English term Vacuum Gas Oil) as well as to deasphalted oils (DAO). These feedstocks contain high contents of sulfur and nitrogen-containing compounds, including among them natural polar compounds.

Patent U.S. Pat. No. 6,248,230 proposes eliminating the natural polar compounds from a hydrocarbon fraction whose distillation interval is in the range of 110° C.-560° C. before catalytic treatment, whereby these compounds have a harmful effect on the desulfurization reactions.

The techniques that are used for their elimination are the adsorption and the extraction with solvent.

Patent FR 2 864 103 of the applicant describes a process in which the hydrocarbon feedstock, of which at least 80% of the compounds have a boiling point of greater than or equal to 340° C., is subjected to a selective extraction of resins, prior to the cracking of this feedstock. According to this process, the resins have a polar nature and primarily consist of condensed naphtheno-aromatic compounds, compounds containing sulfur, nitrogen, or oxygen, and optionally metals such as nickel and vanadium.

The patent application FR 2 830 870 of the applicant discloses an improved process of hydrocracking in one stage, whereby hydrocarbon feedstocks contain high nitrogen contents. The improvement relates to the implementation of a partial separation of ammonia, for example by a hot flash, between the hydrorefining section and the hydrocracking section. For this application, the harmful compound is the nitrogen, and the latter is eliminated in gaseous phase in the form of ammonia, which makes it possible to operate under less strict conditions at the second reactor.

The prior art therefore essentially discloses processes for which the compounds that are harmful to the hydrodesulfurization reaction are extracted prior to the reaction section by a physical separation method, for example by adsorption, by extraction with solvent, or by a flash. These methods are expensive since they require specific equipment.

The inventors have therefore sought a more economical process.

According to this invention, it was found that the fact of treating in a mixture the conventional feedstock of the FCC pretreatment process (vacuum distillate or DAO) with a lighter hydrocarbon fraction, preferably a gas oil fraction, made it possible to obtain better performance levels for said process, i.e., the mild hydrocracking. These performance levels are evaluated primarily in terms of the effectiveness of desulfurization and hydrogenation of the effluent of the mild hydrocracking.

DETAILED DESCRIPTION OF THE INVENTION

Figure 1:
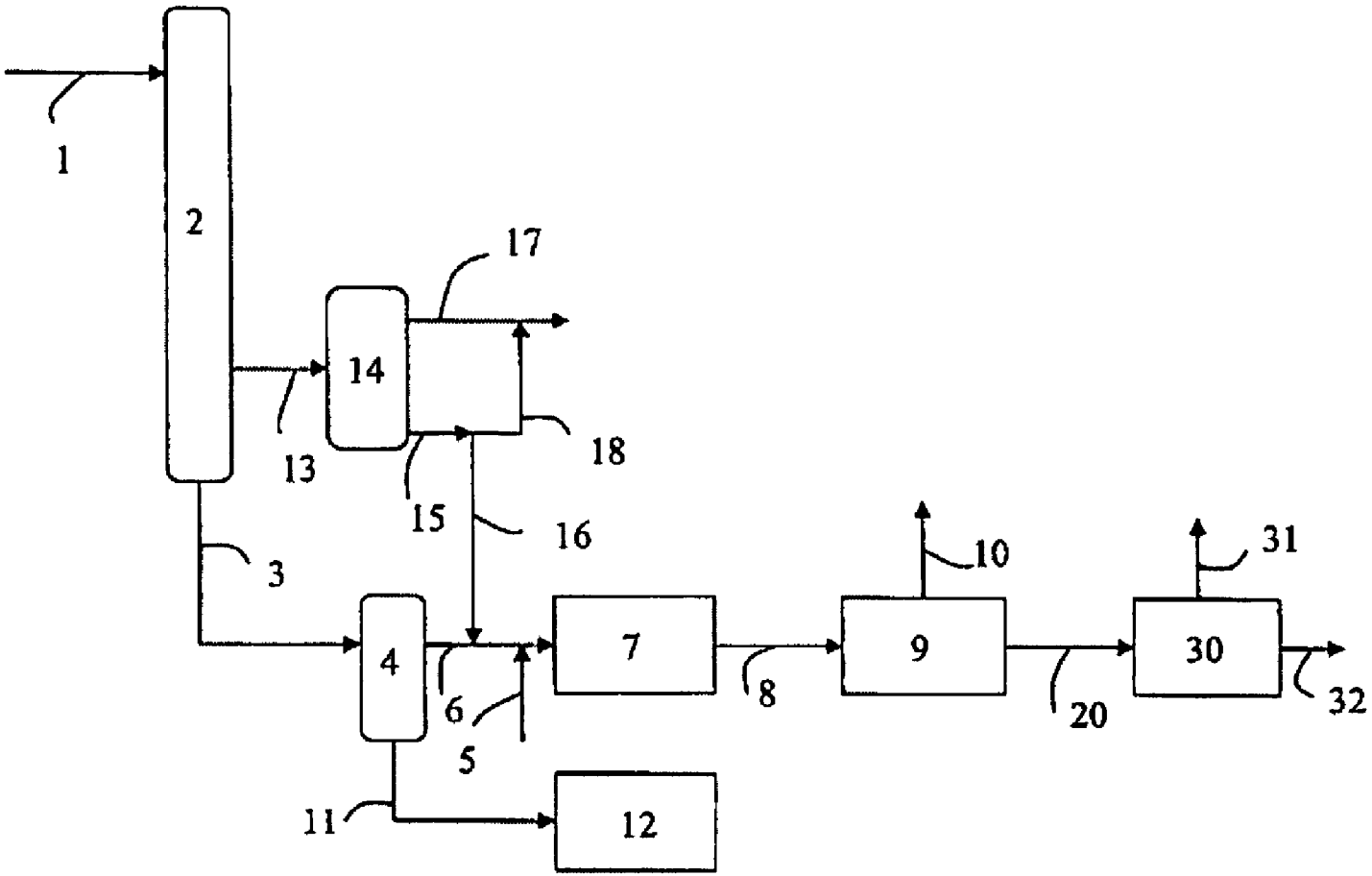
FIGS. 1-4 show process flows representing various embodiments of the invention as explained in greater detail below.

More specifically, the invention describes an FCC pretreatment process by mild hydrocracking of a hydrocarbon feedstock that comprises a vacuum distillate fraction or a deasphalted oil or else a mixture of these two fractions to produce gas oil and an effluent that has an initial boiling point of more than 320° C., whereby said effluent (FCC feedstock) is then subjected to a catalytic cracking. The feedstock also comprises a lighter hydrocarbon fraction, whereby said lighter feedstock is defined in that at least 50% by weight ends below 375° C. and at least 80% by weight ends above 200° C. in terms of the simulated distillation according to the ASTM D2887 standard. A very advantageous feedstock is a gas-oil-type feedstock having a temperature $T_5$ of between 190 and 210° C. (i.e., for which 5% by weight of said feedstock ends below this temperature), and a temperature $T_{95}$ of between 380 and 420° C. (i.e., for which 95% by weight of said feedstock ends below this temperature).

The vacuum distillate fraction is a vacuum distillate that is obtained from the direct distillation of crude or a conversion process such as coking, visbreaking, FCC, the Hyvahl process of the applicant, or else any mixture of the effluents of processes cited above. The list above is not limiting.

The deasphalted oil is obtained from a deasphalting unit. Most often, the residue of the vacuum distillation (vacuum residue) is deasphalted, and said deasphalted residue constitutes the deasphalted oil.

The vacuum distillate fraction or the deasphalted oil, or else a mixture of these two fractions, is part of the composition of said primary feedstock for which at least 85% by weight ends above 375° C., preferably at least 90%. At least 95% by weight of said feedstock ends below 650° C. in terms of the ASTM D2887 simulated distillation.

The sulfur content of the primary feedstock is generally between 0.3% and 4% by weight and preferably between 0.4% and 3.5% by weight.

The total nitrogen content of the primary feedstock is generally between 400 and 5,000 ppm and preferably between 500 and 4,000 ppm by weight.

The basic nitrogen content of the primary feedstock is generally between 200 and 2,000 ppm and preferably between 250 and 1,500 ppm by weight.

The aromatic compound content of the primary feedstock is generally between 10 and 90% by weight and preferably between 40 and 80% by weight.

The hydrogen content of the primary feedstock is generally between 10 and 14% by weight and preferably between 10.5 and 13% by weight.

The lighter fraction, said secondary feedstock, is defined in that at least 50% by weight of said fraction ends below 375° C., and at least 80% of said fraction ends above 200° C. Generally, the lighter fraction is a gas oil fraction.

The sulfur content of the secondary feedstock is generally between 0.05 and 3.0% by weight and preferably between 0.1 and 2.0% by weight.

The total nitrogen content of the secondary feedstock is generally between 10 and 2,000 ppm and preferably between 10 and 400 ppm by weight.

The basic nitrogen content of the secondary feedstock is generally between 5 and 1,000 ppm and preferably between 10 and 200 ppm by weight.

The aromatic compound content of the secondary feedstock is generally between 10 and 90% by weight and preferably between 15 and 40% by weight.

The secondary feedstock advantageously can be a gas oil fraction obtained during the atmospheric distillation from which is obtained the vacuum distillate, a fraction of the gas oil produced by the catalytic cracking unit (LCO gas oil fraction of the FCC) or any other gas oil fraction that is obtained from a conversion process, for example a process of coking, conversion of residue in a fixed bed or in a boiling bed, hydrocracking of vacuum distillate in a fixed bed or in a boiling bed, as well as any mixture of the preceding fractions.

The gas oil fraction preferably consists of the heavy fraction of the direct distillation gas oil.

The lighter fraction, or secondary feedstock, constitutes up to 50% by weight of the total feedstock, composed of the primary feedstock and the secondary feedstock, preferably 5% to 50% by weight, and also preferably 5% to 40% by weight.

Said lighter fraction is preferably free of dissolved gaseous hydrogen. Given these proportions, the total feedstock resulting from the combination of the two feedstocks contains between 0.15 and 4.0% by weight of sulfur, preferably between 0.25 and 3.5% by weight; between 200 and 4,000 ppm by weight of total nitrogen, preferably between 250 and 2,000 ppm by weight; between 100 and 2,000 ppm by weight of basic nitrogen, preferably between 150 and 1,500 ppm by weight, and between 10 and 90% by weight of aromatic compounds, preferably between 25 and 80% by weight.

For the total feedstock, at least 5% by weight of said feedstock ends below 375° C., and at least 80% by weight of said feedstock ends below 650° C., and preferably at least 10% by weight ends below 375° C. and at least 90% ends below 650° C.

The research carried out by the applicant led him to discover that, surprisingly enough, the fact of diluting the conventional feedstock of the FCC pretreatment process in certain proportions leads to even better performance levels of the FCC feedstock pretreatment process.

These better performance levels of pretreatment affect the FCC itself since products with a lower sulfur content are thus obtained at the outlet of the FCC.

The dilution that is carried out upstream from the FCC pretreatment process has the effect of lowering the concentration of inhibiting compounds of the hydrotreatment reactions (hydrodesulfurization, hydrodenitrification, hydrogenation of aromatic compounds, cracking), such as nitrogen, basic nitrogen, and the aromatic compounds of the primary feedstock. Certain compounds that have a basic nature (for example basic nitrogen) are well known for reducing the cracking activity of the acid catalysts such as the silica-aluminas or the zeolites.

The dilution also has the effect of reducing the concentration in reagents, i.e., sulfur, nitrogen, aromatic compounds and the fraction of the feedstock that can be cracked, for example the compounds that boil above 375° C. Opposite to the effect of the reduction of inhibiting compounds, the effect of the reduction of reagents is to reduce the hydrotreatment reaction speed.

The research carried out by the applicant led him to discover that a dilution that is carried out, according to certain proportions determined in this invention, upstream from the FCC pretreatment process has a positive overall effect on the hydrotreatment reaction speed.

In other words, surprisingly enough, the positive effect of the deconcentration of the inhibiting compounds on the reaction speed, induced by the dilution, is predominant relative to the negative effect of the deconcentration of the reagents.

Another advantage of the process is to improve the properties of the gas oil fraction exiting from the FCC pretreatment process (after an FCC gas oil/feedstock fraction separation stage), in addition in terms of sulfur content, density (measured at 15° C.) and the cetane number.

Typically, if the dilution is not carried out, the gas oil exiting from the FCC pretreatment process has the following characteristics: $D_{15}$: 0.875-0.890; sulfur content: 50-500 ppm by weight; cetane number: 32-40.

By using the dilution according to the invention, these same characteristics return to the following ranges: $D_{15}$: 0.845-0.855, sulfur content: 5-200 ppm by weight, cetane number: 48-52.

Thus, with a subsequent hydrotreatment under moderate operating conditions, a gas oil that meets the current specifications could be obtained.

The addition of the secondary feedstock to the primary feedstock also has consequences over the contact time of the total feedstock with the catalyst.

In terms of operation of the FCC pretreatment reactor, it is possible to envisage several possibilities, for example to preserve the same total feedstock flow rate or else to preserve the same DSV flow rate. In the first case, the hydraulic flow is kept constant, which comes down to saying that the feedstock/catalyst contact time is also kept constant, whereas in the second case, the contact time is reduced proportionally to the dilution factor.

Surprisingly enough, the research carried out by the applicant led him to discover that, in certain proportions determined by this invention, the addition of a light fraction carried out upstream from the FCC pretreatment process has an overall positive effect by increasing the speed of the hydrotreatment reactions, whereby the effect of deconcentration of the inhibitors is greater than those combined with the reduction of the contact time and the deconcentration of the reagents. This positive effect of the dilution can be reflected, advantageously, either by a smaller amount of catalyst that is used while obtaining identical performance levels at the pretreatment of the FCC feedstock in the absence of dilution, or by improved performance levels of pretreatment of the feedstock while preserving the same quantity of catalyst that is used.

Description of the FCC Pretreatment Process

The mixture of the primary feedstock and the secondary feedstock as described above is treated by the FCC pretreatment process (or mild hydrocracking) that is well known to one skilled in the art. The hydrogen is provided in a gaseous phase at the reactor via a pipe that is different from that of the feedstock.

The procedure is usually performed under an absolute pressure of 2 to 12 MPa, often 2 to 10 MPa, and most often 4 to 9 MPa or 3 to 7 MPa at a temperature of between 300 and 500° C., and preferably between 350 and 450° C.

The hourly volumetric flow rate (VVH) and the partial hydrogen pressure are selected based on the characteristics of the feedstock to be treated and the desired conversion. Most often, the VVH is in a range that extends from 0.1 to 10 $h^{-1}$, and preferably from about 0.2 $h^{-1}$ to about 5 $h^{-1}$. The total quantity of hydrogen mixed with the feedstock (including the chemical consumption and the recycled quantity) is usually from about 100 to about 5,000 $Nm^3$ of hydrogen per $m^3$ of liquid feedstock and most often from 100 to 2,000 $Nm^3/m^3$. Generally, it is at least 200 $Nm^3/m^3$ and preferably from 200 to 1,500 $Nm^3/m^3$. The net conversion of products boiling below 375° C. is generally between 5 and 50% by weight, advantageously between 10 and 45% by weight.

The effluent of the mild hydrocracking process is separated into a gas oil fraction for which the distillation interval is between 130 and 390° C., and a fraction that has an initial boiling point above 320° C., treated downstream by the FCC process. In addition, gasoline fractions are also obtained during the separation.

The fraction of the effluent of the mild hydrocracking that has an initial boiling point of more than 320° C. contains less than 0.25% by weight of sulfur, and preferably less than 0.15%.

Generally, the fraction that has an initial boiling point above 320° C. is treated downstream via the FCC process, but the latter could also, for example, be sent to the fuel pole to produce a fuel with a very low sulfur content.

Catalyst that is Used

It is possible to use a standard catalyst for hydroconversion that comprises, on an amorphous substrate, at least one metal or metal compound that has a hydro-dehydrogenating function.

This catalyst can be a catalyst that comprises metals of group VIII, for example nickel and/or cobalt, most often in combination with at least one metal of group VIB, for example molybdenum and/or tungsten. It is possible, for example, to use a catalyst that comprises 0.5 to 10% by weight of nickel (expressed in terms of nickel oxide NiO) and from 1 to 30% by weight of molybdenum, preferably 5 to 20% by weight of molybdenum (expressed in terms of molybdenum oxide $MnO_3$) on an amorphous mineral substrate.

The total content of metal oxides of groups VI and VIII in the catalyst is generally between 5 and 40% by weight and preferably between 7 and 30% by weight. The ratio by weight (expressed on the basis of metal oxides) between metal (metals) of group VI and metal (metals) of group VII is, in general, from about 20 to about 1, and most often from about 10 to about 2. The substrate will be, for example, selected from the group that is formed by alumina, silica, silica-aluminas, magnesia, clays, and mixtures of at least two of these minerals. This substrate can also contain other compounds and, for example, oxides that are selected from among boron oxide, zirconia, titanium oxide, and phosphoric anhydride. Most often an alumina substrate, and preferably η- or γ-alumina, is used.

The catalyst can also contain a promoter element such as phosphorus and/or boron. This element may have been introduced into the matrix or preferably have been deposited on the substrate. Silicon may also have been deposited on the substrate by itself or with phosphorus and/or boron. The catalysts preferably contain silicon that is deposited on a substrate such as alumina, optionally with phosphorus and/or boron deposited on the substrate and also containing at least one metal of group VIII (Ni, Co) and at least one metal of group VIB (Mo, W). The concentration of said element is usually less than about 20% by weight (based on oxide) and most often less than about 10%. The boron trioxide ($B_2O_3$) concentration is usually from about 0 to about 10% by weight.

Another catalyst is a silica-alumina that comprises at least one metal of group VIII and at least one metal of group VIB.

Another type of catalyst that can be used is a catalyst that contains at least one matrix, at least one Y zeolite and at least one hydro-dehydrogenating metal.

The matrices, metals and additional elements described above can also be part of the composition of this catalyst.

Advantageous Y-zeolites are described in the patent applications WO-00/71641 and EP-911 077 as well as U.S. Pat. Nos. 4,738,940 and 4,738,941.

Certain compounds that have a basic nature, such as basic nitrogen, are well known for significantly reducing the cracking activity of the acid catalysts such as the silica-aluminas or the zeolites. The more pronounced the acidic nature of the catalyst (silica-alumina, and even zeolite), the more the reduction of the concentration of basic compounds by dilution will have a beneficial effect on the mild hydrocracking reaction.

Preferred embodiments of the process of the invention will be illustrated below in the figures, with different secondary feedstocks emanating from the process for treatment of crude oil as a whole.

These secondary feedstocks may have come from the distillation train of other crudes, or more generally could be feedstocks outside of the process for treatment of crude oil as a whole.

The invention also relates to an installation that can be used for the implementation of the process according to the invention, i.e., for carrying out a pretreatment process of an FCC feedstock.

Preferred embodiments are illustrated in FIGS. 1 to 4.

Figure 2:
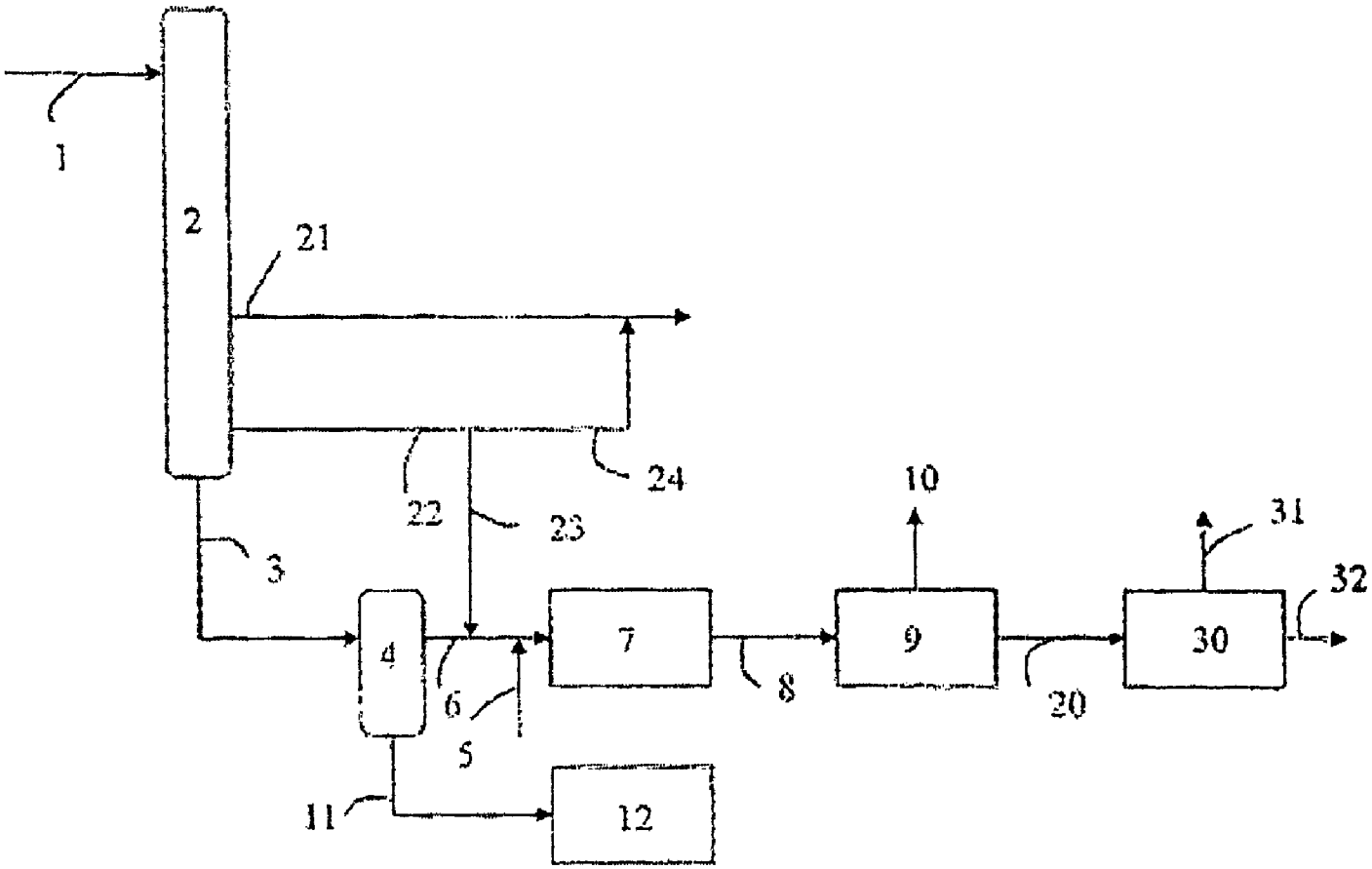
Figure 3:
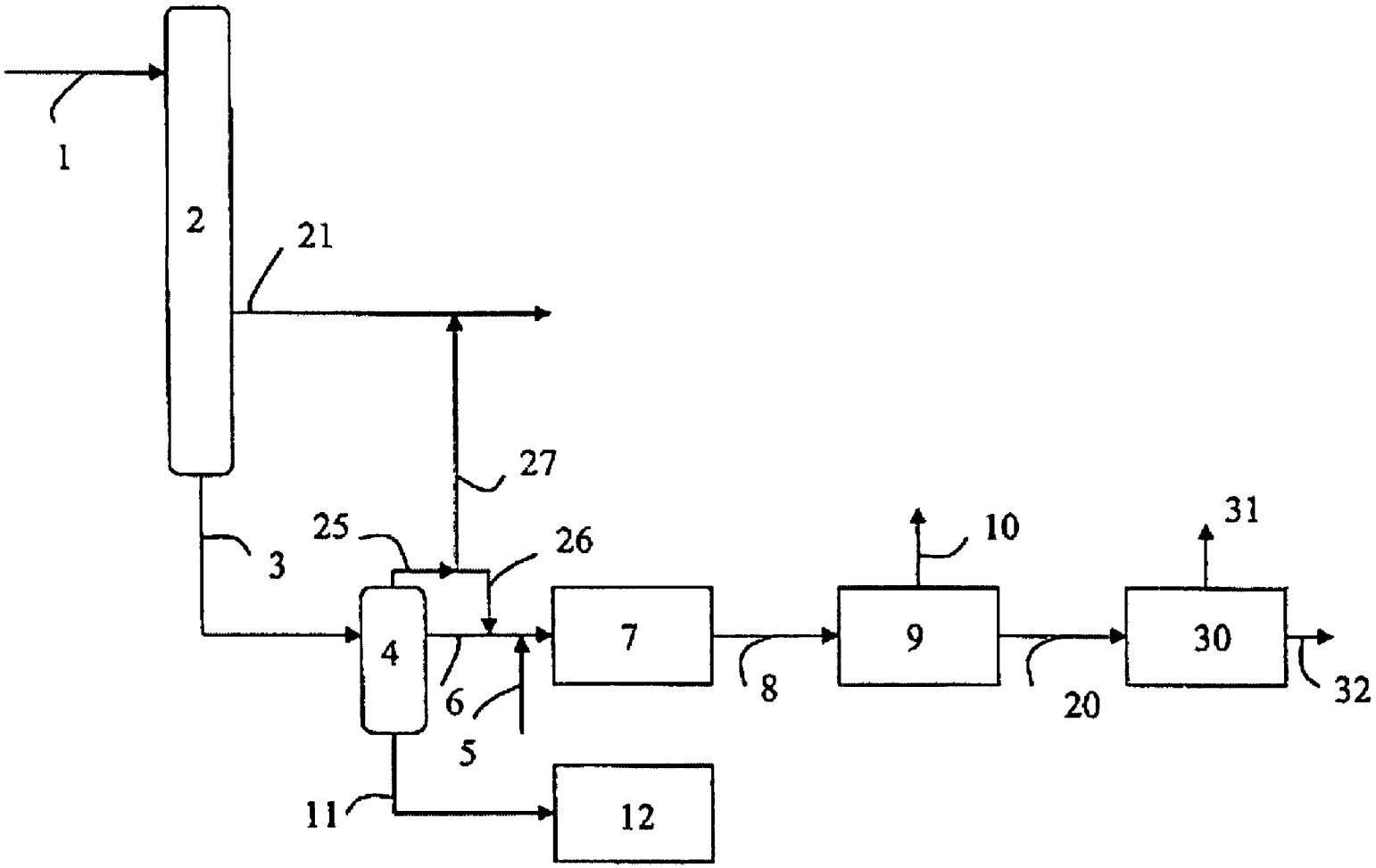

According to FIGS. 1 to 3, a vacuum distillate is treated without mixing with the deasphalted oil.

This installation comprises, in a general way:

- A mild hydrocracking section (7) that contains a catalyst and is equipped with a pipe (5) for the introduction of hydrogen, a pipe (6) for the introduction of the primary feedstock that is a vacuum distillate and/or a deasphalted oil and of which at least 85% by weight ends above 375° C., and a pipe for the introduction of a so-called secondary feedstock, of which at least 50% by weight ends below 375° C., and at least 80% by weight ends above 200° C., and a pipe (8) for the evacuation of the effluent,
- A section for separation (9) that is equipped with a pipe for the introduction of said effluent and at least one pipe (20) for the evacuation of a fraction that has an initial boiling point of more than 320° C., and a pipe (10) for separating a fraction whose distillation interval is between 130 and 390° C.,
- A section (30) for catalytic cracking (FCC) that is equipped with a pipe (20) for the introduction of said fraction with an initial boiling point of more than 320° C., at least one pipe (31) for the output of a light gas oil for catalytic cracking (LCO according to the English term) and at least one pipe (32) for the output of a heavy gas oil for catalytic cracking (HCO according to the English term).

Among the products that exit from the catalytic cracking section, there appear, among others, an LCO fraction that optionally can be part of the composition of the secondary feedstock via a recycling pipe, an HCO fraction, a gasoline fraction and a slurry fraction.

More specifically, this installation generally comprises:

A column (2) for atmospheric distillation of crude oil equipped with a pipe (1) for the introduction of a crude oil, at least one pipe for drawing off a gas oil fraction and a pipe (3) for drawing off atmospheric residue, A vacuum distillation column (4) that is equipped with a pipe (3) for the introduction of said atmospheric residue and at least one pipe (6) for drawing off a vacuum distillate and a pipe (11) for drawing off the vacuum residue, Optionally a deasphalting unit (28) that is equipped with a pipe (11*a*) for the introduction of at least a portion of the vacuum residue, a pipe (33) that introduces the deasphalted oil that is obtained into the mild hydrocracking section (7) and a pipe (34) for the output of asphalt, A mild hydrocracking section (7) that contains a catalyst and is equipped with a pipe (5) for the introduction of hydrogen, a pipe (6) for the introduction of the primary feedstock that is a vacuum distillate and/or a deasphalted oil, of which at least 85% by weight ends above 375° C., and a pipe for the introduction of a so-called secondary feedstock, of which at least 50% by weight ends below 375° C. and at least 80% by weight ends above 200° C., and a pipe (8) for the evacuation of the effluent, A separation section (9) that is equipped with a pipe for the introduction of said effluent and at least one pipe (20) for the evacuation of a fraction that has an initial boiling point of more than 320° C., and a pipe (10) for separating a fraction whose distillation interval is between 130 and 390° C., A section (30) for catalytic cracking (FCC) that is equipped with a pipe (20) for the introduction of said fraction with an initial boiling point of more than 320° C., at least one pipe (31) for the output of an LCO, and at least one pipe (32) for the output of an HCO.

DETAILED DESCRIPTION OF FIGS. 1, 2, 3 AND 4

FIG. 1 describes an embodiment of the invention. This embodiment is provided by way of example and does not exhibit any limiting nature.

This embodiment also comprises general characteristics that are cited above:

A pipe (13) for the evacuation of said gas oil separated in the atmospheric column (2), A distillation section (14) that is equipped with a pipe (17) for evacuating a light gas oil fraction and also a pipe (15) for evacuating a heavy gas oil fraction, A pipe (16) for the introduction of at least a portion of said heavy fraction (secondary feedstock) into the pipe (6) that introduces said primary feedstock into the mild hydrocracking section (7).

FIG. 1:

The crude oil is sent via a pipe (1) into an atmospheric distillation column (2). From this distillation column, a gas oil fraction is drawn off via a pipe (13) and an atmospheric residue is drawn off via a pipe (3). The vacuum residue is sent to a vacuum distillation (4) whose vacuum residue is extracted via a pipe (11) that feeds a conversion process (12), for example a coker. The distillate of the vacuum distillation (4) is drawn off via a pipe (6) and sent to a mild hydrocracking process (7), fed by hydrogen via a pipe (5). A fraction of a heavy gas oil fraction representing 5 to 50% of the total feedstock that passes into the pipe (6) is also introduced into the pipe (6) via a pipe (16). According to this embodiment, this fraction is extracted via the pipe (15) of a distillation section (14) that is fed via the pipe (13) by a gas oil fraction that is obtained from the atmospheric distillation column (2). The remainder of the heavy gas oil fraction that does not pass through the pipe (16) is sent via a pipe (18), mixed in a pipe (17), with the light gas oil fraction that is obtained from the distillation section (14). The mixture of the fluids of pipes (17) and (18) is preferably sent to a hydrotreatment process (not shown in FIG. 1) so as to bring the gas oil up to the specifications. The effluent (8) of the mild hydrocracking process (7) constitutes, after different separation stages represented by the block (9) whose purpose is to separate, a gas oil fraction of which the distillation interval is between 130 and 390° C., extracted via a pipe (10), and a fraction that is extracted via a pipe (20) that has an initial boiling point of more than 320° C. that can advantageously constitute the feedstock of the FCC process represented by the block (30).

FIG. 2 describes another embodiment of the invention.

In addition to the general characteristics cited above, the installation comprises:

A pipe (21) for drawing off a light gas oil fraction and a pipe (22) for drawing off a heavy gas oil fraction from the atmospheric column (2), A pipe (23) for the introduction of at least a portion of said heavy gas oil fraction (secondary feedstock) into the pipe (6) that introduces the primary feedstock into the mild hydrocracking section (7).

In the process that is used, the vacuum distillate fraction and/or the deasphalted oil are obtained from an atmospheric distillation of a crude oil, making it possible to separate at least one light gas oil fraction, a heavy gas oil fraction and an atmospheric residue, whereby the residue is distilled under vacuum to produce at least one vacuum distillate and one vacuum residue.

Said vacuum distillate and/or a deasphalted oil that is obtained from the deasphalting of said vacuum residue is treated by mild hydrocracking.

At least a portion of said heavy gas oil fraction is introduced (secondary feedstock) into the primary feedstock that is treated with mild hydrocracking.

According to a variant, a portion of the heavy gas oil is introduced into the primary feedstock, whereby the other portion is mixed with the light gas oil fraction.

FIG. 2:

The crude oil is sent via a pipe (1) into an atmospheric distillation column (2). From this distillation column, a light gas oil fraction is drawn off via a pipe (21), a heavy gas oil fraction via a pipe (22) and an atmospheric residue via the pipe (3). The residue is sent to a vacuum distillation (4) from which the vacuum residue is extracted via a pipe (11) that feeds a conversion process (12), for example a coker.

The vacuum distillation distillate (4) is drawn off via a pipe (6) and sent to a mild hydrocracking process (7), fed by hydrogen via a pipe (5). A fraction of the heavy gas oil fraction transported into the pipe (22) is also introduced into the pipe (6), via a pipe (23). This fraction represents 5 to 50% of the total feedstock that passes into the pipe (6). The remainder of the heavy gas oil fraction that does not pass via the pipe (23) is sent via a pipe (24), mixed in the pipe (21), with the light gas oil fraction that is obtained from the atmospheric distillation (2). The mixing of the fluids from pipes (21) and (24) is preferably sent to a hydrotreatment process (not shown in FIG. 2) so as to bring the gas oil up to specifications. The effluent (8) of the mild hydrocracking process (7) constitutes, after different stages of separation represented by the block (9) whose purpose is to separate, a gas oil fraction whose distillation interval is between 130 and 390° C., extracted via a pipe (10), and a fraction that is extracted via a pipe (20) that has an initial boiling point of more than 320° C. that can advantageously constitute the feedstock of the FCC process represented by the block (30).

FIG. 3 describes another embodiment of the invention.

In addition to the general characteristics, the installation comprises:

- A pipe (21) for drawing off a light gas oil fraction from the atmospheric column (2) and a pipe (3) for drawing off the atmospheric residue and a heavy gas oil fraction,
- A pipe (25) for evacuating a heavy gas oil fraction from said vacuum distillation column,
- A pipe (26) for the introduction of at least a portion of said heavy gas oil fraction (secondary feedstock) into the pipe (6) that introduces said primary feedstock into the mild hydrocracking section (7).

In the process that is used, the vacuum distillation fraction and/or the deasphalted oil are obtained from an atmospheric distillation of a crude oil, making it possible to separate at least one light gas oil fraction and an atmospheric residue that contains a heavy gas oil fraction, whereby said residue is distilled under vacuum for separating at least one vacuum distillate, a vacuum residue and a heavy gas oil fraction. At least a portion of said heavy gas oil fraction is introduced (secondary feedstock) into the primary feedstock that is treated by mild hydrocracking.

According to a variant, the other portion of said heavy gas oil fraction is mixed with the light gas oil fraction.

FIG. 3:

The crude oil is sent via a pipe (1) into an atmospheric distillation column (2). A light gas oil fraction is drawn off via a pipe (21) and an atmospheric residue is drawn off via the pipe (3) from this distillation column. The residue is sent to a vacuum distillation (4) whose vacuum residue is extracted via a pipe (11) that feeds a conversion process (12), for example a coker.

The vacuum distillation distillate (4) is drawn off via a pipe (6) and is sent to a mild hydrocracking process (7), fed by hydrogen via a pipe (5). A fraction of the heavy gas oil fraction, also extracted from the vacuum distillation (4) via a pipe (25), is also introduced into the pipe (6), via a pipe (26). This fraction represents 5 to 50% of the total feedstock that passes into the pipe (6). The remainder of the heavy gas oil fraction that does not pass via the pipe (26) is sent via a pipe (27), mixed in pipe (21), with the light gas oil fraction that is obtained from the atmospheric distillation (2). The mixture of the fluids from pipes (21) and (27) is preferably sent to a hydrotreatment process (not shown in FIG. 3) so as to bring the gas oil up to specifications.

The effluent (8) of the mild hydrocracking process (7) constitutes, after various stages of separation represented by the block (9) whose purpose is to separate, a gas oil fraction whose distillation interval is between 130 and 390° C., extracted via a pipe (10), and a fraction that is extracted via a pipe (20) that has an initial boiling point of more than 320° C. that can advantageously constitute the feedstock of the FCC process represented by the block (30).

Figure 4:
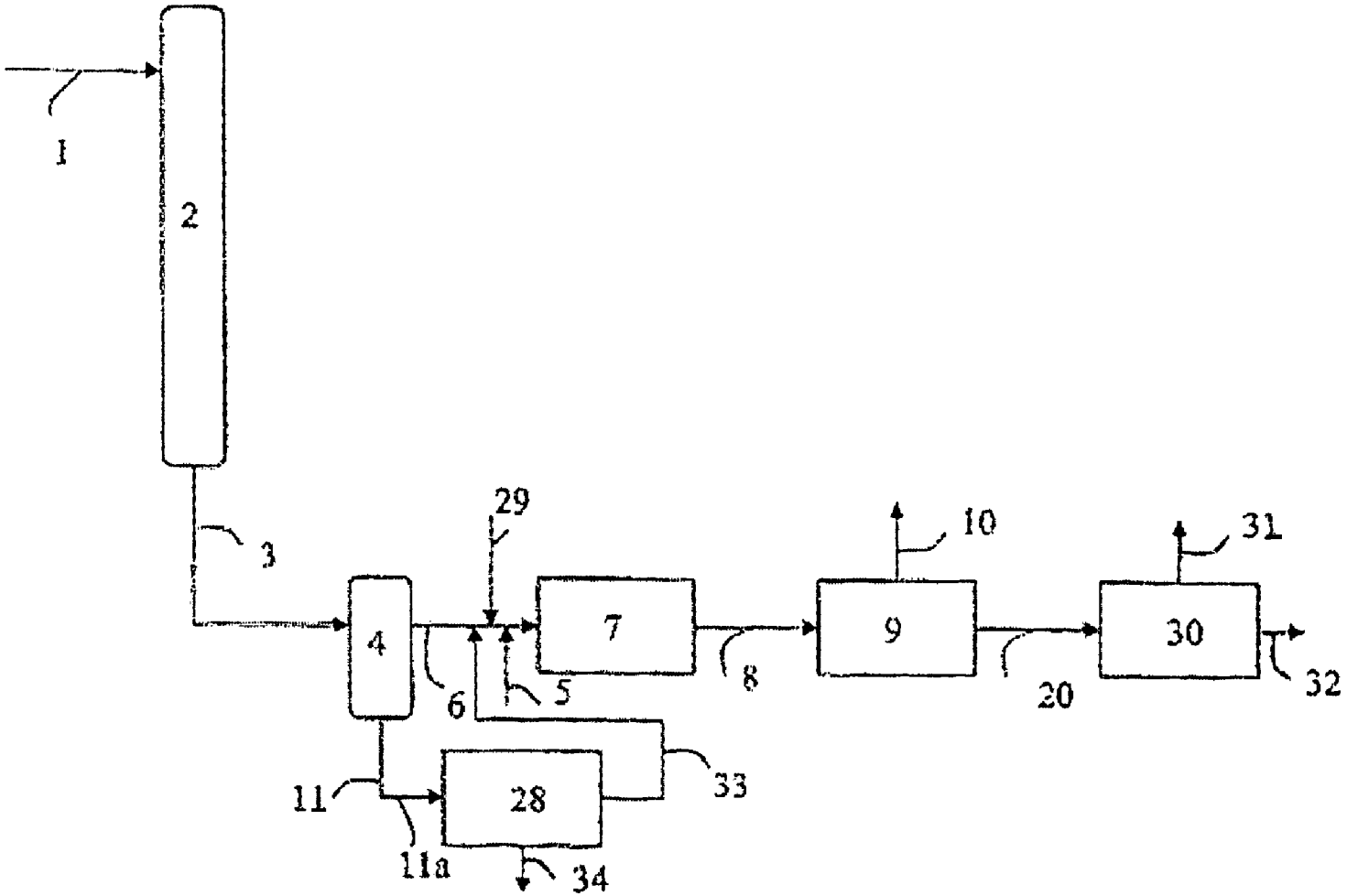

FIG. 4:

In FIG. 4, the treatment of a mixture of a vacuum distillate feedstock and deasphalted oil by mild hydrocracking is shown.

The columns (2) and (4), the primary feedstock (6) that is a vacuum distillate, the mild hydrocracking section (7), the separation section (9) and the FCC section (30) are identified.

The vacuum residue that exits via the pipe (11) is sent via the pipe (11*a*) into a deasphalting unit (28), and a deasphalted residue (or deasphalted oil) exits via the pipe (33) and asphalt exits via the pipe (34). To declutter the figure, the input and output of the deasphalting solvent were not shown; these arrangements are well known to one skilled in the art. The deasphalted oil is brought into the pipe (6) where the primary feedstock circulates.

According to the invention, a secondary feedstock is also supplemented via the pipe (29). The mixture is subjected to the mild hydrocracking of the section (7).

Advantageously, all of the arrangements of FIGS. 1 to 3 for the production of the secondary feedstock (29) can be transposed in this figure.

The secondary feedstock of the pipe (29) can also be a feedstock outside of the installation; the same holds true for FIGS. 1 to 3.

In FIG. 4, a treatment of a vacuum distillate and deasphalted oil mixture was shown. It would be equally possible to treat the deasphalted oil by itself with mild hydrocracking, whereby the vacuum distillate of the pipe (6) is then intended for another use.

Also in this case, all of the arrangements of FIGS. 1 to 3 for the production of the secondary feedstock (29) are transposable, whereby the feedstock (29) can also be an outside feedstock. Furthermore, in the FIGS. 1 to 3 where a vacuum distillate is treated by mild hydrocracking in the section (7), the vacuum residue is advantageously introduced completely or partially into a conversion section (12) via the pipe (11), whereby the other portion of the residue, brought via the pipe (11*a*), can be used to produce a deasphalted oil that can be treated by the process and the installation according to the invention.

The conversion section (12) was not shown in FIG. 4.

Example 1

Not According to the Invention

A Heavy Arabian vacuum distillate that has the properties cited in Table 1 is treated by mild hydrocracking in a pilot unit with an isothermal fixed bed that contains the catalyst of formulation NiMo (HR548 marketed by AXENS).

TABLE 1

Characteristics of the Vacuum Distillate

| | Feedstock According to Example 1 |
|---|---|
| Density 15/4 | 0.9414 |
| Sulfur (% by Weight) | 2.92 |
| Nitrogen (ppm) | 1,357 |
| Basic N (ppm) | 427 |
| Aromatic Compounds (% by Weight) | 52.7 |
| Hydrogen Content (% by Weight) | 11.72 |
| C7 Asphaltenes (% by Weight) | <0.02 |
| T5% Simulated Distillation | 399 |
| T10% Simulated Distillation | 422 |
| T20% Simulated Distillation | 445 |
| T30% Simulated Distillation | 464 |
| T40% Simulated Distillation | 479 |
| T50% Simulated Distillation | 494 |
| T60% Simulated Distillation | 510 |
| T70% Simulated Distillation | 526 |
| T80% Simulated Distillation | 543 |
| T90% Simulated Distillation | 566 |
| T95% Simulated Distillation | 582 |

TABLE 1-continued

| Characteristics of the Vacuum Distillate | Feedstock According to Example 1 |
|---|---|
| Fraction of 375° C.+, % by Weight | 97.9 |
| Fraction of 150-375° C., % by Weight | 2.1 |
| Pour Point (° C.) | 39 |

The feedstock is introduced with the hydrogen under the following operating conditions that are representative of the FCC pretreatment process:

Total pressure=50 bar

VVH relative to the catalyst of 1.0 volume of feedstock/volume of catalyst/h.

Quantity of $H_2$ per liter of feedstock=400 Nl/l measured at the outlet of the reactor The temperature of the catalyst is selected to have a desulfurization rate (HDS) of 97.72% defined by:

$$HDS = 100 * \frac{(Sfeedstock - Sproduct)}{Sfeedstock}$$

The latter is in the range of 350-400° C.

The effluent that exits from the reactor is separated into a gaseous phase and a liquid phase at ambient temperature and pressure by a set of separators. Then, the liquid phase is stripped continuously with hydrogen to remove the residual $H_2S$. The liquid phase is distilled in a laboratory in a Pi-150° C. fraction, a 150-375° C. fraction, and a 375° C.+ fraction.

The yields by weight relative to the feedstock and several properties of these fractions are summarized in Table 2:

TABLE 2

| Fractions | |
|---|---|
| PI-150° C. | Yield relative to the feedstock (% by weight) = 2.0<br>D15/4 = 0.765<br>Sulfur (ppm) = 20 |
| 150-375° C. | Yield relative to the feedstock (% by weight) = 18.0<br>D15/4 = 0.888<br>Sulfur (ppm) = 365<br>Cetane D613 = 33 |
| 375° C.+ | Yield relative to the feedstock (% by weight) = 77.5<br>D15/4 = 0.904<br>Sulfur (ppm) = 775<br>Nitrogen (ppm) = 555<br>Hydrogen content (% by weight) = 12.49 |

Example 2

According to the Invention

A mixture is produced that contains 21.38% by weight of direct distillation gas oil (23.08% by volume) and 78.62% by weight (76.92% by volume) of the vacuum distillate of Example 1 and obtained from the same crude. The characteristics of the gas oil and the mixture are summarized in Table 3:

TABLE 3

| Characteristics of the Direct Distillation Gas Oil and the Mixture | Direct Distillation Gas Oil (Heavy Gas Oil) | Mixture (21.38% by Weight of GO of Direct Dist. + 78.62% by Weight of DSV of Example 1) |
|---|---|---|
| Density 15/4 | 0.8537 | 0.9225 |
| Sulfur (% P) | 1.35 | 2.60 |
| Nitrogen (ppm) | 126 | 1,105 |
| Basic N (ppm) | 47 | 335 |
| Aromatic Compounds (% by Weight) | 30.2 | 48.2 |
| Hydrogen Content (% by Weight) | 13.09 | 12.00 |
| C7 Asphaltenes (% by Weight) | — | <0.02 |
| T5% Simulated Distillation | 219 | 275 |
| T10% Simulated Distillation | 245 | 310 |
| T20% Simulated Distillation | 272 | 365 |
| T30% Simulated Distillation | 290 | 425 |
| T40% Simulated Distillation | 304 | 450 |
| T50% Simulated Distillation | 317 | 475 |
| T60% Simulated Distillation | 330 | 492 |
| T70% Simulated Distillation | 344 | 514 |
| T80% Simulated Distillation | 359 | 535 |
| T90% Simulated Distillation | 375 | 560 |
| T95% Simulated Distillation | 386 | 580 |
| Fraction of 375° C.+, % by Weight | 10 | 79 |
| Fraction of 150-375° C., % by Weight | 90 | 21 |

The mixture, of which 21% by weight ends below 375° C., is introduced into the same pilot unit as in Example 1 and hydrotreated in the same volume of the AXENS catalyst, according to the same operating procedure and under the following conditions:

Total pressure=50 bar

VVH relative to the catalyst of 1.3 vol/vol/h so as to treat per hour the same quantity of vacuum distillate volume as in Example 1

$H_2$ quantity per liter of feedstock=400 Nl/l measured at the outlet of the reactor Temperature of the catalyst=identical to that of Example 1

The effluent that exits from the reactor is separated into a gaseous phase and a liquid phase at ambient temperature and pressure by a set of separators. Then, the liquid phase is stripped continuously with hydrogen to remove the residual $H_2S$. The liquid phase is distilled in the laboratory in a Pi-150° C. fraction, a 150-375° C. fraction and a 375° C.+ fraction.

The yields by weight relative to the feedstock and several properties of these fractions are summarized in Table 4.

TABLE 4

| Fractions | |
|---|---|
| PI-150° C. | Yield relative to the feedstock (% by weight) = 1.2<br>D15/4 = 0.764<br>Sulfur (ppm) = 15 |

TABLE 4-continued

| Fractions | |
|---|---|
| 150-375° C. | Yield relative to the feedstock (% by weight) = 33.8<br>D15/4 = 0.853<br>Sulfur (ppm) = 120<br>D613 Cetane = 50.5 |
| 375° C.+ | Yield relative to the feedstock (% by weight) = 62.4<br>D15/4 = 0.899<br>Sulfur (ppm) = 600<br>Nitrogen (ppm) = 450<br>Hydrogen content (% by weight) = 12.55 |

It is observed that the presence in the feedstock of the FCC pretreatment process of 21.38% by weight of a gas oil fraction, of which 90% by weight ends below 375° C., makes it possible to improve the desulfurization and the hydrogenation of the FCC feedstock (375+ fraction) and makes it possible to obtain a gas oil (150-375° C. fraction) with a lower sulfur content exhibiting a higher cetane number than in Example 1. The quantity of vacuum distillate treated per hour remains the same as that of Example 1.

For this example, the feedstock/catalyst contact time is less than in the case of Example 2 (deviation of 21.4%); however, the performance levels in terms of desulfurization and hydrogenation of the 375+ fraction, which constitutes the FCC feedstock, are better.

Example 3

According to the Invention

The mixture of Example 2, of which 21% by weight ends below 375° C., is introduced into the same pilot unit as in Example 1 and hydrotreated in the same volume of the AXENS catalyst, according to the same operating procedure and under the following operating conditions:

Total pressure=50 bar

VVH relative to the catalyst of 1.0 vol/vol/h, identical to that of Example 1 so as to preserve the same contact time Quantity of $H_2$ per liter of feedstock=400 N l/l measured at the outlet of the reactor Catalyst temperature: Identical to that of Example 1

The effluent that exits from the reactor is separated into a gaseous phase and a liquid phase at ambient temperature and pressure by a set of separators. Then, the liquid phase is stripped continuously with hydrogen to remove the residual $H_2S$. The liquid phase is distilled in the laboratory into a Pi-150° C. fraction, a 150-375° C. fraction, and a 375° C.+ fraction.

The yields by weight relative to the feedstock and several properties of these fractions are summarized in Table 5.

TABLE 5

| Fractions | |
|---|---|
| PI-150° C. | Yield relative to the feedstock (% by weight) = 1.8<br>D15/4 = 0.765<br>Sulfur (ppm) = 10 |
| 150-375° C. | Yield relative to the feedstock (% by weight) = 35.7<br>D15/4 = 0.854<br>Sulfur (ppm) = 50<br>D613 Cetane = 49 |

TABLE 5-continued

| Fractions | |
|---|---|
| 375° C.+ | Yield relative to the feedstock (% by weight) = 60.0<br>D15/4 = 0.896<br>Sulfur (ppm) = 350<br>Nitrogen (ppm) = 120<br>Hydrogen content (% by weight) = 12.8 |

It is observed that the presence in the feedstock of the FCC pretreatment process of 21.38% by weight of a gas oil fraction, of which 90% by weight ends below 375° C., improves the desulfurization and the hydrogenation of the FCC feedstock (375+ fraction) and makes it possible to obtain a gas oil (150-375° C. fraction) with a lower sulfur content that has a higher cetane number than in Example 1. For a contact time of the feedstock with the catalyst that is identical to that of Example 1, the desulfurization gain of the 375+ fraction is 55%, and the hydrogenation gain is 2.5%.

The entire disclosures of all applications, patents and publications, cited herein and of corresponding French application No. 05/05.865, filed Jun. 9, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for treatment of a total hydrocarbon feedstock in which:

a gas oil fraction and an atmospheric residue are drawn off by atmospheric distillation of a crude oil, a vacuum distillate that is sent into mild hydrocracking is drawn off by vacuum distillation of said atmospheric residue, said vacuum distillate, as a primary feedstock is such that at least 85% by weight of said primary feedstock boils above 375° C. and at least 95% by weight of said primary feedstock boils below 650° C., is treated by mild hydrocracking in the presence of hydrogen and a catalyst, whereby the mild hydrocracking is performed under an absolute pressure of 2 to 12 MPa and a temperature of between 300 and 500° C., and in the presence of a lighter hydrocarbon fraction, a so-called secondary feedstock, consisting essentially of a gas oil fraction for which the temperature $T_5$ is between 190 and 210° C. and the temperature $T_{95}$ is between 380 and 420° C., to achieve a net conversion of products boiling below 375° C. of 5 to 50% b.w., the effluent that is obtained from the mild hydrocracking is separated to provide a fraction that has an initial boiling point of more than 320° C., and containing less than 0.25% by weight of sulfur, —and a gas oil fraction whose distillation range is between 130 and 390° C., having a $D_{15}$: 0.845-0.855, sulfur content: 5-200 ppm by weight, cetane number: 48-52, said fraction that has an initial boiling point of more than 320° C. is sent into a catalytic cracking section to obtain an LCO and an HCO.

2. A process according to claim 1, wherein said lighter fraction constitutes up to 50% by weight of the total feedstock that consists of the primary feedstock and said lighter fraction.

3. A process according to claim 2, wherein said lighter fraction constitutes between 5% and 40% by weight of the total feedstock that consists of the primary feedstock and the lighter fraction.

4. A process according to claim 1, wherein said lighter fraction is essentially free of dissolved gaseous hydrogen.

5. A process according to claim 1, wherein the total feedstock contains between 0.15 and 1.0% by weight of sulfur, between 200 and 4,000 ppm by weight of total nitrogen, between 100 and 2,000 ppm by weight of basic nitrogen, and between 10 and 90% by weight of aromatic compounds.

6. A process according to claim 1, wherein at least 5% of said total feedstock ends below 375° C. and at least 80% by weight ends below 580° C.

7. A process according to claim 1, wherein said vacuum distillate fraction and/or a deasphalted oil are obtained from an atmospheric distillation of a crude oil, making it possible to separate at least one gas oil fraction and an atmospheric residue, whereby said residue is vacuum-distilled to separate at least one vacuum distillate and one vacuum residue, said vacuum distillate and/or a deasphalted oil obtained from the deasphalting of said vacuum residue is/are treated by mild hydrocracking, whereby the secondary feedstock is obtained from the distillation of said gas oil fraction separated into at least one light gas oil fraction and a heavy gas oil fraction, at least a portion of said heavy gas oil fraction is introduced (secondary feedstock) into the primary feedstock that is treated by mild hydrocracking.

8. A process according to claim 7, in which a portion of the heavy gas oil fraction is introduced into the primary feedstock, whereby the other portion is mixed with the light gas oil fraction.

9. A process according to claim 1, wherein said vacuum distillate fraction and/or a deasphalted oil are obtained from an atmospheric distillation of a crude oil, making it possible to separate at least one light gas oil fraction, a heavy gas oil fraction, and an atmospheric residue, whereby said residue is vacuum-distilled to produce at least one vacuum distillate and a vacuum residue, said vacuum distillate and/or a deasphalted oil obtained from the deasphalting of said vacuum residue is/are treated by mild hydrocracking, at least a portion of said heavy gas oil fraction is introduced (secondary feedstock) into the primary feedstock that is treated by mild hydrocracking.

10. A process according to claim 9, in which a portion of the heavy gas oil fraction is introduced into the primary feedstock, whereby the other portion is mixed with the light gas oil fraction.

11. A process according to claim 1, wherein said vacuum distillate fraction and/or a deasphalted oil are obtained from an atmospheric distillation of a crude oil, making it possible to separate at least one light gas oil fraction and an atmospheric residue that contains a heavy gas oil fraction, whereby said residue is distilled under vacuum to separate at least one vacuum distillate, a vacuum residue and a heavy gas oil fraction, at least a portion of said heavy gas oil fraction is introduced (secondary feedstock) into the primary feedstock that is treated by mild hydrocracking.

12. A process according to claim 11, in which the other portion of the heavy gas oil fraction is mixed with the light gas oil fraction.

13. A process according to claim 1 for the treatment of vacuum distillate in which the vacuum residue is subjected completely or partially to a conversion process.

* * * * *